US006446306B1

(12) United States Patent
Salice

(10) Patent No.: US 6,446,306 B1
(45) Date of Patent: Sep. 10, 2002

(54) HINGE

(75) Inventor: Luciano Salice, Carimate (IT)

(73) Assignee: Arturo Salice S.p.A., Novedrate/Como (IT)

( * ) Notice: Subject to any disclaimer, the term of this patent is extended or adjusted under 35 U.S.C. 154(b) by 0 days.

(21) Appl. No.: 09/468,566

(22) Filed: Dec. 21, 1999

(30) Foreign Application Priority Data

Dec. 21, 1998 (DE) ..... 298 22 770 U

(51) Int. Cl.[7] ..... E05D 7/12

(52) U.S. Cl. ..... 16/245; 16/387; 16/240; 16/246

(58) Field of Search ..... 16/257, 258, 237, 16/238, 239, 240, 245, 246

(56) References Cited

U.S. PATENT DOCUMENTS

| | | | | | |
|---|---|---|---|---|---|
| 3,590,420 | A | * | 7/1971 | Salice | 16/335 |
| 4,800,622 | A | * | 1/1989 | Rock et al. | 16/240 |
| 4,839,940 | A | * | 6/1989 | Grass | 16/258 |
| 4,888,853 | A | * | 12/1989 | Rock et al. | 16/240 |
| 5,054,164 | A | * | 10/1991 | Blanco-Equiluz | 16/258 |
| 5,056,190 | A | * | 10/1991 | Rock et al. | 16/257 X |
| 5,159,740 | A | * | 11/1992 | Brustle et al. | 16/258 |
| 5,239,730 | A | | 8/1993 | Grass | |
| 5,253,390 | A | | 10/1993 | Gross et al. | |
| 5,444,895 | A | * | 8/1995 | Salice | 16/278 |
| 6,061,872 | A | * | 5/2000 | Albrecht et al. | 16/258 |

FOREIGN PATENT DOCUMENTS

| | | |
|---|---|---|
| DE | 3538888 | 5/1987 |
| DE | 3841405 | 1/1990 |
| EP | 0491990 | 7/1992 |
| EP | 0369261 | 8/1992 |
| EP | 0509355 | 10/1992 |
| EP | 0538240 | 4/1993 |
| JP | 2-176085 A * | 7/1990 |

* cited by examiner

*Primary Examiner*—Lynne H. Browne
*Assistant Examiner*—Ernesto Garcia
(74) *Attorney, Agent, or Firm*—Dilworth & Barrese LLP

(57) ABSTRACT

The invention is directed to a spacer for a hinge, the spacer being connected to a base plate and formed as an essentially U-shaped part of plate steel having legs provided with hooks on ends opposite the oblong hole. The bridging part of the spacer comprises, between the hooks, a resilient tongue having an actuating piece on the end side. The actuating piece is provided, in the region of the hooks, with a transverse flat flute. Journals or pins disposed at an end region of the legs of the hinge arm can be pushed in against the force of the resilient tongue in a manner such that the journals or pins are locked between the base of the hooks and one flank of the flat flute.

17 Claims, 4 Drawing Sheets

HINGE

BACKGROUND OF THE INVENTION

The invention relates to a hinge with an essentially U-shaped hinge arm which is connected in an articulated manner, preferably by two hinge toggles, to a swivellable hinge part and which is held via a spacer on a base plate by an annular groove of a joint adjusting screw engaging an openly ending oblong hole at the end of the spacer near the joint and by locking means.

A hinge of this type is known from EP 0 369 261 B1 where the spacer is connected to the hinge arm by a setscrew and the joint adjustment screw and is made of plastic. The spacer is provided at its ends with hooks, of which one hook is designed resiliently and is provided with a slanted incline edge so that after hanging the joint-side hook on the bridge part of a U-shaped base plate, the spacer can be locked into place with this by pressing down the resilient hook part until this clicks into place behind the opposite edge of the bridge part, with a bulge engaging a transverse opening of the bridge part being provided between the hooks. In this known hinge, the hinge arm is connected to the base plate by the hooks made of plastic of the spacer made completely of plastic so that a not very solid connection is made between the hinge arm and the base plate because the intermediate plate consists of an elastic plastic.

SUMMARY OF THE INVENTION

It is therefore the object of the invention to provide a hinge of the type first given which is characterized by a simple design and by a better solidity. Furthermore, the easily mounted hinge should allow a simple adjustment vertically, laterally and in the depth of the piece of furniture.

This object is solved in accordance with the invention by the spacer being connected to the base plate and consisting of an essentially U-shaped part of plate steel whose legs are provided with hooks on their ends opposite the oblong hole and by the bridge part of the spacer comprising between the hooks a resilient tongue with an actuating piece on the end side and being provided in the region of the hooks with a transverse flat flute in which the retaining means, e.g., extensions or journals pointing inwards or a pin connecting the legs, disposed at the end region of the legs of the hinge arm can be pushed in against the force of the resilient tongue in such a way that these are locked between the base of the hooks and one flank of the flat flute.

As in the hinge in accordance with the invention the spacer is made of plate steel, the desired solid connection between hinge arm and base plate is ensured. The hinge arm can be locked into place on the spacer in a simple manner by the annular groove of the joint adjustment screw being pushed into the engaging region of the openly ending oblong hole and the opposite end of the hinge arm subsequently being pressed down so that the retaining means disposed on the legs snap into a locking position between the hooks and the flank of the flat flute forming an abutment.

The hinge in accordance with the invention allows a simple side adjustment of, for example, a door borne thereby only by actuation of the joint adjustment screw, because the retaining means locked into the hook mouths form a kind of swivel axis around which the hinge arm can be swivelled relative to the base plate. An adjustment in the depth of the piece of furniture is possible by the spacer being provided in its bridge part with a fixing borehole comprising an oblong hole, through which fixing borehole a fixing screw connecting the spacer to the base plate is screwed. A vertical adjustment is possible by the base plate being provided on both sides with wing-like fixing flanges which are provided with oblong holes transversely to the spacer through which fixing screws can be screwed into the panel of the piece of furniture.

One particular advantage of the invention comprises, for instance, the hinge arm being able to be fixed directly on the base plate by the fixing screw fixing the spacer on the base plate even without said spacer. For this purpose, the bridge part of the hinge arm is provided with an oblong hole through which the fixing screw engages and which allows an adjustment of the hinge arm in the depth of the piece of furniture.

In another embodiment, however, the spacer can instead be guided adjustably in guides of the base plate, for example, by a cam or it can also form a uniform base plate itself.

In accordance with a preferred embodiment it is provided that the hooks point in the direction of the joint and that an abutment is bent out of the resilient tongue, which abutment is supported in the interlocked state on the journals or the pin so that these are clamped between the hooks and the abutment. In this embodiment of the invention, the journals or the pin are supported on the base of the hook mouths open towards the joint and are held in this interlocked position by the abutment. The abutment creates a better interlocking support than would be ensured by a flat flute of the flank alone.

In accordance with another embodiment it is provided that the hooks point backwards. In order to create a more solid snap connection with this embodiment too, in another aspect of the invention it is provided that the actuation part is provided with laterally protruding extensions which grip behind the rear sides of the legs in the state of the journals or of the pin pressed into the hook mouth.

To prevent the resilient tongue carrying the actuating piece from being pressed down too much and so being bent, the legs bearing the hooks are appropriately provided on their rear lower end regions with extensions limiting the swivel path of the actuating piece.

Appropriately, the rear sides of the legs are tapered at their lower end regions so that the inner edges of the protruding extensions can slide on these sides forming kinds of wedge surfaces up to a clamping engagement.

BRIEF DESCRIPTION OF THE DRAWINGS

One embodiment of the invention is described below in more detail by means of the drawing in which.

DESCRIPTION OF THE PREFERRED EMBODIMENTS

Figure 13:
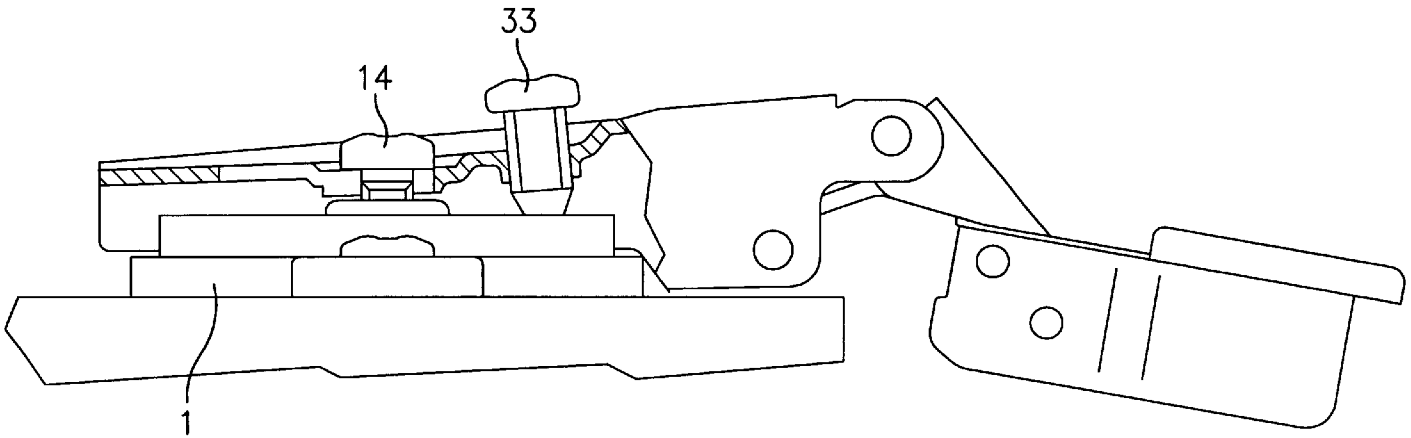
FIG. 13 shows a side view of a hinge, partially in section, in which the hinge arm is screwed to the base plate without a spacer.
Figure 1:
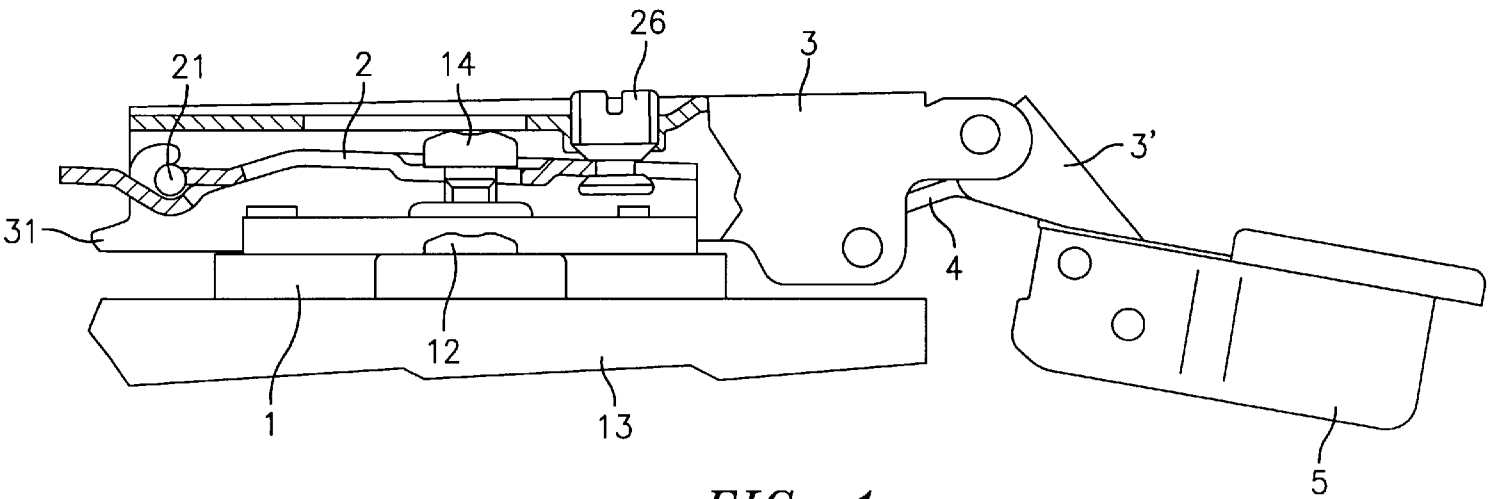
FIG. 1 shows a side view of a first embodiment of the hinge in accordance with the invention, partially in section.
Figure 2:
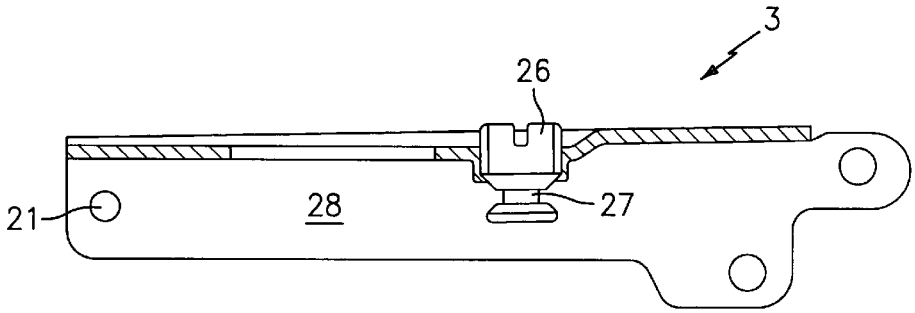
FIG. 2 shows a longitudinal section through the hinge arm of the hinge of FIG. 1.
Figure 3:
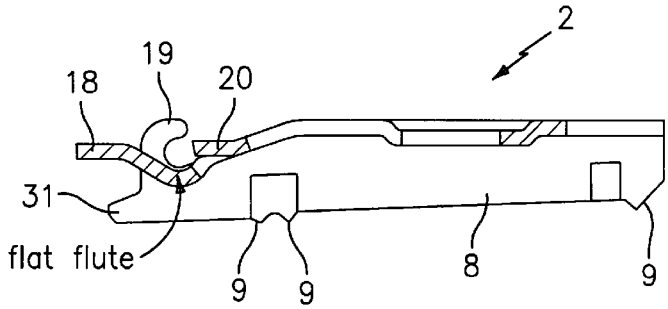
FIG. 3 shows a longitudinal section through the spacer of the hinge of FIG. 1.
Figure 4:
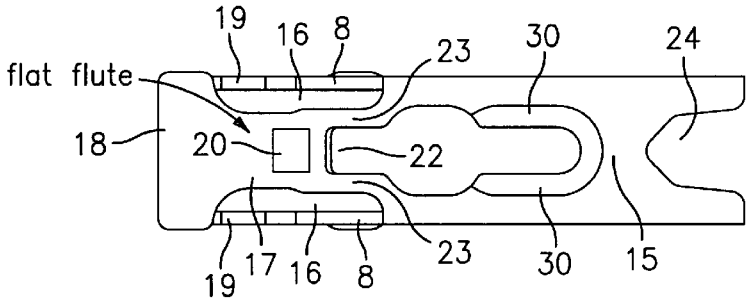
FIG. 4 shows a top view of the spacer of FIG. 3.
Figure 5:
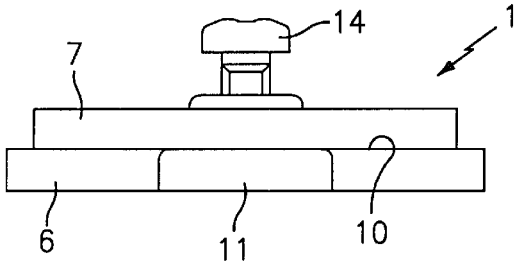
FIG. 5 shows a side view of the base plate of the hinge of FIG. 1.
Figure 6:
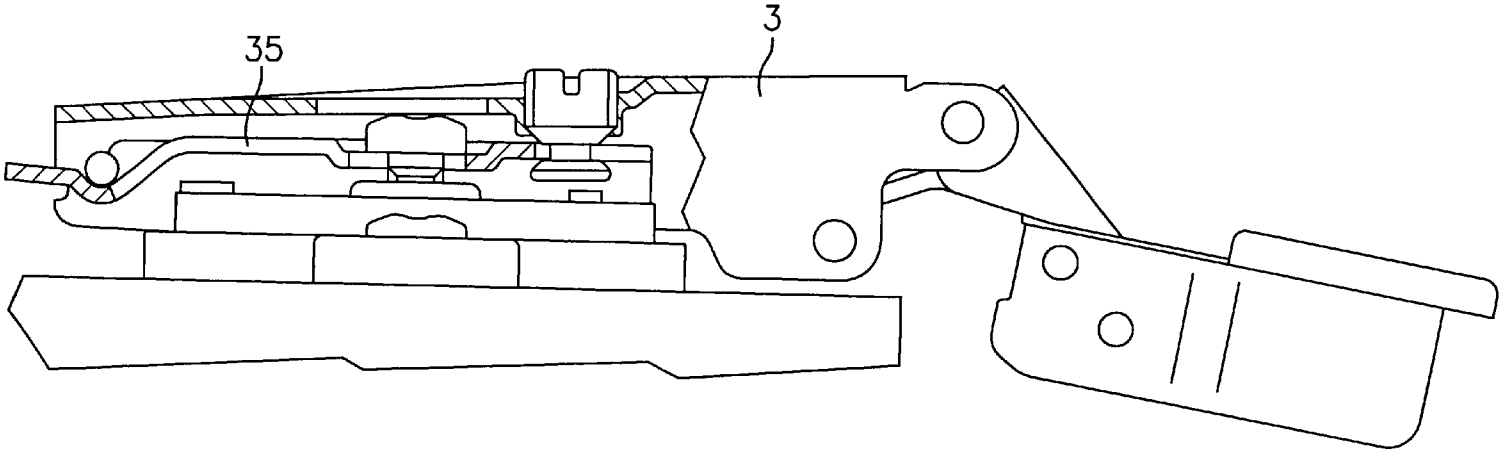
FIG. 6 shows a side view of a second embodiment of the hinge in accordance with the invention, partially in section.
Figure 9:
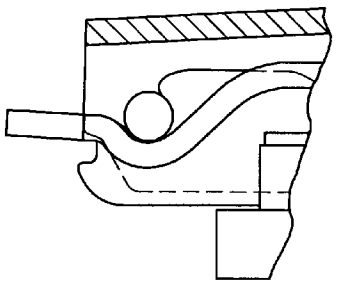
FIGS. 7 to 9 show different positions of the pin connecting the legs of the hinge arm during the snapping into the hinge's hook mouth open to the back shown in FIG. 6.
Figure 8:
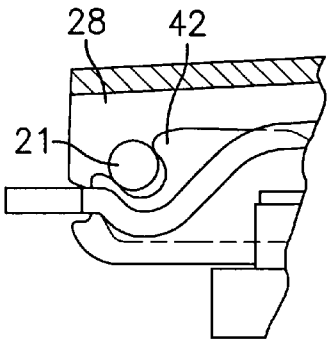
Figure 7:
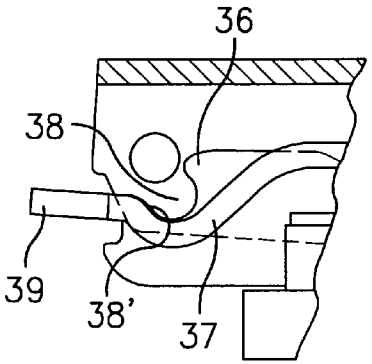
Figure 10:
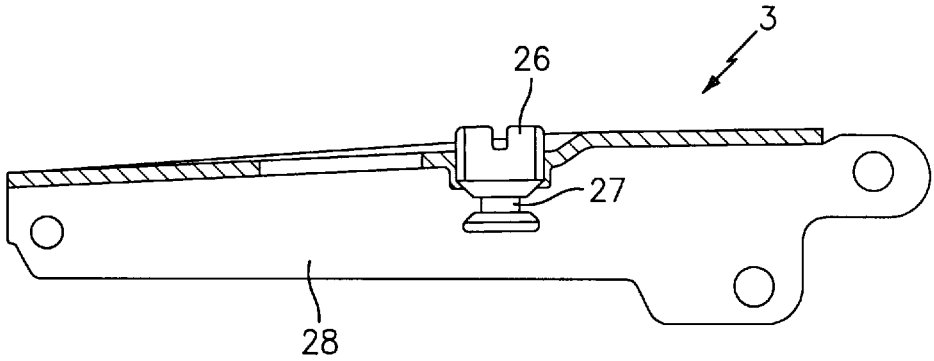
FIG. 10 shows a longitudinal section through the hinge arm of the hinge of FIG. 6.
Figure 11:
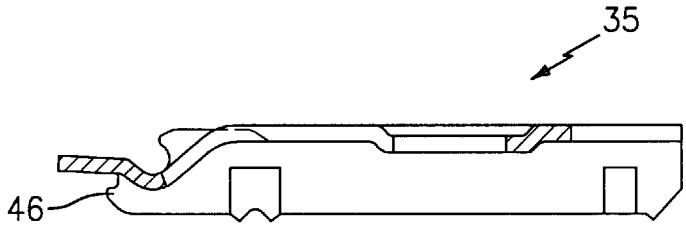
FIG. 11 shows a longitudinal section through the spacer of the hinge of FIG. 6.
Figure 12:
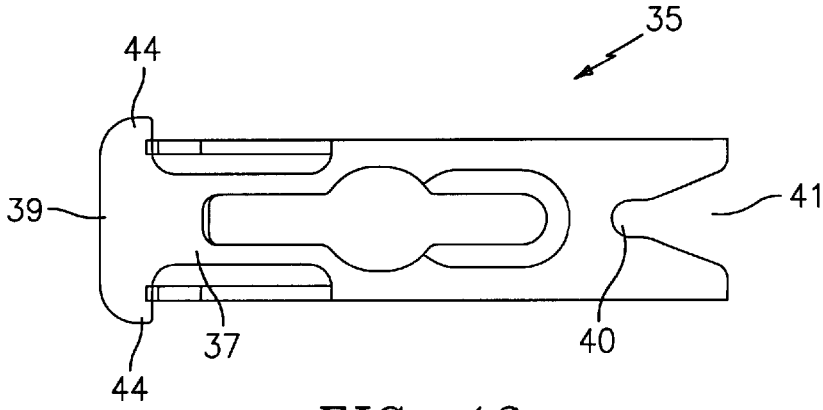
FIG. 12 shows a top view of the spacer of FIG. 11.

As can be seen from FIGS. 1 to 5, the first embodiment of the hinge in accordance with the invention consists of a base plate 1, a spacer 2 screwed thereto and, snapped onto the spacer 2, a hinge arm 3 which is connected to a cup-shaped awivable hinge part 5 in a conventional manner by two links 3', 4.

The base plate 1 consists of an elongated middle part 6 U-shaped in cross section from whose bridge part an equally elongated ramp-shaped elevation 7 has bent out which is equally U-shaped in cross-section. The width of the ramp-shaped elevation 7 is smaller than the width of the elongated middle part 6 so that to both sides of the ramp-shaped elevation 7 on the bridge part of the middle part 6, shoulders 10 are formed which serve to support the lower edges of the legs 8 of the U-shaped spacer 2. Here, the distance of the legs 8 of the spacer 2 corresponds to the width of the ramp-shaped elevation 7 so that the spacer 2 is held on the base plate 1 free of any twist. The lower edges of the legs of the spacer 2 are provided with tooth-like protrusions 9 which engage the corrugations provided on the shoulders 10 of the base plate 1.

The base plate 1 is provided with wing-like extensions 11 symmetrically to the transverse centre-line, which form fixing flanges and which are provided with oblong holes whose centre lines are aligned with the transverse centre line of the base plate. Fixing screws 12 are screwed through the oblong holes which fixing screws 12 connect the base plate 1 to the panel 13 of a piece of furniture.

The ramp-shaped elevation is provided in its centre region with a flanged tapped hole in which a fixing screw 14 can be screwed.

The base plate 1 is made completely of a stamped sheet metal part.

The spacer or intermediate plate 2 also consists of a U-shaped, toughened stamped sheet metal part. The bridge part 15 is provided in its rear end region with lateral cut-outs 16 through which a resilient tongue 17 is cut free. The resilient tongue possesses on its rear end a widened actuating part 18 which can be actuated by hand. The side legs 8 are provided in their rear end region with hooks 19 pointing to the joint-side end. In the region of these hooks, the resilient tongue 17 is provided with a channel-shaped recess which can be seen from FIG. 3 in front of the apex of this channel-shaped recess, another tongue 20 pointing towards the hooks 19 is bent out of the resilient tongue 17, which tongue 20 forms an abutment for the pin 21 which can snap into the hook mouths of the hooks 19.

In its middle region, the bridge part 15 is provided with a keyhole-shaped oblong hole for the fixing screw 14. The oblong hole is extended into the resilient tongue 7 by a narrower rectangular section 22 so that the resilient bridges 23 improving the elasticity are formed.

At its front end, the bridge part possesses an openly ending oblong hole 24.

The hinge arm 3 is provided in its bridge part with a flanged tapped hole in which the joint adjusting screw 26 is screwed. This possesses in its lower end region an annular groove 27 with which this engages the bottom of the openly ending oblong hole 24.

At its rear end, the hinge arm 3 is provided with a pin 21 connecting its legs 28 which pin 21 can be snapped into place in the hook mouths of the hooks 19.

To mount the hinge arm 3, first the base plate 1 is connected to the side panel 13 of the piece of furniture by the fixing screws 12. The spacer screw 2 is screwed to the base plate 1 by the fixing screw 14, with the head of the fixing screw 14 being supported on the recessed edges 30 of the keyhole-shaped oblong hole. The hinge arm 3 is snapped into place with the spacer or intermediate plate 2 by the annular groove 27 of the joint adjustment screw 26 being pushed into the openly ending oblong hole 24 to just before its engagement position in which the pin comes to rest on the abutment 20 in front of the mouths of the hooks 19. By pressing on the rear end region of the hinge arm, the resilient tongue 17 is pressed down so that the pin 21 snaps into the hook mouth and is-held therein by the front edge of the abutment 20. By the snapping into place of the pin 21 in the mouth of the hooks 19, the hinge arm 3 is moved back a small amount so that the annular groove 27 engages the narrowing part of the oblong hole 24.

To release the snap connection, the actuating part 18 is pressed down. To prevent any excessive pressing down of this actuating part, the legs 8 of the spacer 2 are provided on their rear ends with extensions 31 which prevent any excessive pressing down.

As can be seen from FIG. 13, the hinge arm 3 can also be connected to the base plate 1 directly by the fixing screw 14 without the spacer 2. To allow a lateral adjustment, a joint adjustment screw 33 is provided which is then supported directly on the base-like elevation 7. To allow a lateral adjustment, the fixing screw 14 has to be released or tightened accordingly.

The embodiment of FIGS. 6 to 12 differs from that of FIGS. 1 to 5 essentially in a different design of the spacer 35. The spacer 35 is provided at the rear ends of its legs which have been cut free with hooks 36 pointing backwards. The hooks possess hook mouths 38 which are provided beginning from a rounded off base with openly ending flanks. The rear flank 38' runs diagonally backwards so that it forms a guide path for the pin 21 which can be pressed in.

The resilient tongue 37 cut out is provided in the region of the hook mouths 38 with a transverse channel-like recess. At its rear end, the resilient tongue 37 bears an actuating part 39.

The bridge part of the spacer 35 is provided on its side near the joint with an openly ending oblong hole 41 which subsequent to its rounded base possesses a narrowed-section 40, with the width of said narrowed section 40 being adapted to the diameter of the shaft part of the joint adjustment screw 26 in the base of the annular groove 27.

The actuating part 39 is provided at its sides with extensions 44 gripping behind the legs 28 of the hinge arm 3. In the locked in place state, these extensions 44 grip behind the rear side edges of the legs 28 of the hinge arm 3.

To assemble the hinge arm 3 on the spacer screwed to the base plate, first the annular groove 27 is inserted into the longer reaching narrowed end section 40 of the oblong hole 41. Then the rear end of the hinge arm 3 is pressed down in the manner visible from FIGS. 7 to 9, with the rear end regions of the legs 28 being supported on the lateral extensions 44 of the actuating part 39. As soon as the pin 21 has entered into the hook mouth 38 via the rounded upper side 42 of the hook 36, the hinge arm is given a slight movement in the direction of the joint by sliding onto the slanted flanks 38' of the hook mouths, with the pin 21 entering increasingly completely into the hook mouth 38. Through this shift, the lateral extensions 44 can grip in snapping manner behind the rear edges of the legs 28, with this gripping being made more simple by the wedge-shaped slants of the rear edges of the legs 28 of the hinge arm 3. The shifting of the hinge arm 3 outwards during the process of snapping into place is only so small that the annular groove 27 of the joint adjustment screw 26 does not come out of the narrowed section 40 of the oblong hole 41 and so is still retained in the narrowed section 40.

To release the snap connection, the actuating part 39 is pressed down, with extensions 46 being provided at the rear end regions of the legs of the spacer 35 which prevent any excessive pressing down.

What is claimed is:

1. A hinge with an essentially U-shaped hinge arm (3), a swivellable hinge part (5) connected, in an articulated manner, to said hinge arm (3), a base plate (1), a spacer (2, 35) structured and arranged to retain said hinge arm (3) upon said base plate (1), said spacer (2, 35) comprising an openly ending oblong hole (24,41) at an end thereof near a joint, and said hinge arm (3) being held on said base plate (1) by a joint adjusting screw (26) comprising an annular groove (27) thereof engaging said openly ending oblong hole (24, 41) of said spacer (2,35), said spacer (2, 35) being connectable to said base plate (1) and made of an essentially U-shaped part of plate steel having legs (8) provided, on ends thereof opposite said oblong hole (24, 31), with hooks (19, 36), a bridge part (15) of said spacer (2, 35) being arranged between said hooks (19, 36) and comprising a resilient tongue (17, 37) having an end-side actuating piece (18, 39) and said tongue 17, 37 provided, in a region of said hooks (19), with a transverse flat flute, said hinge arm (3) comprising legs (28) having an end region with a retaining means (21) disposed to be inserted into said transverse flat flute, such that said retaining means (21) can be pressed in against a force of said resilient tongue (17) in such a way to be locked in place between a base of said hooks (19) and a flank of said flat flute, and said transverse flat flute being structured and arranged to abut said retaining means (21) in a locked position.

2. A hinge with an essentially U-shaped hinge arm (3), a swivellable hinge part (5) connected, in an articulated manner, to said hinge arm (3), a base plate (1), a spacer (2, 35) structured and arranged to retain said hinge arm (3) upon said base plate (1), said spacer (2, 35) comprising an openly ending oblong hole (24,41) at an end thereof near a joint, and said hinge arm (3) being held on said base plate (1) by a joint adjusting screw (26) comprising an annular groove (27) thereof engaging said openly ending oblong hole (24, 41) of said spacer (2,35), said spacer (2, 35) being connectable to said base plate (1) and made of an essentially U-shaped part of plate steel having legs (8) provided, on ends thereof opposite said oblong hole, with hooks (19, 36), a bridge part (15) of said spacer (2, 35) being arranged between said hooks (19, 36) and comprising a resilient tongue (17, 37) having an end-side actuating piece (18, 39) and said tongue (17, 37) provided, in a region of said hooks (19), with a transverse flat flute, said hinge arm (3) comprising legs (28) having an end region with a retaining means (21) disposed to be inserted into said transverse flat flute, such that said retaining means (21) is pressed in against a force of said resilient tongue (17) in such a way to be locked in place between a base of said hooks (19) and a flank of said flat flute, wherein said hooks (19) point in a direction of said joint (34) and an abutment (20) is bent from said resilient tongue (17) which, in an interlocked state, is supported on said retaining means (21) to be clamped between said hooks (19) and said abutment (20).

3. A hinge in accordance with claim 1, wherein said hooks (36) point backwardly.

4. A hinge in accordance with claim 3, wherein said actuating piece (39) is provided with laterally protruding extensions (44) which are structured and arranged to grip behind rear sides of said legs (28) of said hinge arm (3) in a state of said retaining means being pressed into a mouth (38) of each said hook (36).

5. A hinge in accordance with claim 4, wherein the rear sides are slanted in a wedge-shape (45) in lower end regions thereof.

6. A hinge with an essentially U-shaped hinge arm (3), a swivellable hinge part (5) connected, in an articulated manner, to said hinge arm (3), a base plate (1), a spacer (2, 35) structured and arranged to retain said hinge arm (3) upon said base plate (1), said spacer (2, 35) comprising an openly ending oblong hole (24,41) at an end thereof near a joint, and said hinge arm (3) being held on said base plate (1) by a joint adjusting screw (26) comprising an annular groove (27) thereof engaging said openly ending oblong hole (24, 41) of said spacer (2,35), said spacer (2, 35) being connectable to said base plate (1) and made of an essentially U-shaped part of plate steel having legs (8) provided, on ends thereof opposite said oblong hole (24, 31), with hooks (19, 36), a bridge part (15) of said spacer (2, 35) being arranged between said hooks (19, 36) and comprising a resilient tongue (17, 37) having an end-side actuating piece (18, 39) and said tongue (17, 37) provided, in a region of said hooks (19), with a transverse flat flute, said hinge arm (3) comprising legs (28) having an end region with a retaining means (21) disposed to be inserted into said transverse flat flute, such that said retaining means (21) is pressed in against a force of said resilient tongue (17) in such a way to be locked in place between a base of said hooks (19) and a flank of said flat flute, wherein said legs (8) of said spaceer (2,35) are each provided, at a rear lower region thereof, with an extension (31, 46) for limiting a swivel path of said actuating piece (18, 39).

7. A hinge in accordance with claim 2, wherein said legs (8) of said spacer (2, 35) are each provided, at a rear lower end region thereof, with an extension (31, 46) for limiting swivel path of said actuating piece (39).

8. A hinge in accordance with claim 1, wherein said retaining means being constituted by one of extensions pointing inwardly, journals or a pin (21) connecting the legs (28) of the hinge arm (3).

9. A hinge in accordance with claim 1, wherein said hinge arm (3) is connected by two hinge toggles (3', 4) to the swivellable hinge part (5).

10. A hinge in accordance with claim 1, wherein the hooks (19) are formed as rigid parts of the spacer (2).

11. A hinge in accordance with claim 1 wherein said hinge arm (3) and said spacer (2) are structured and arranged to be coupled together by a snap connection, and said base plate (1) comprises a fixing screw (14) structured and arranged to clamp or screw said spacer (2) to said base plate (1) through a keyhole-shaped oblong hole provided in said bridge part (15) of said spacer (2) and comprising recessed edges (30) upon which a head of said fixing screw (14) is supported upon clamping.

12. A hinge in accordance with claim 1, wherein said hooks (19) point, upon clamping, upwardly in a direction towards the hinge arm (3) and away from said base plate (1).

13. A hinge in accordance with claim 11, wherein said hooks (19) point, upon clamping, upwardly in a direction towards said hinge arm (3) and away from said base plate (1).

14. A hinge in accordance with claim 11, wherein said hinge arm (3) and spacer (2) are structured and arranged to be coupled together by a snap connection on said retaining means into a mouth of each said hooks (19).

15. A hinge in accordance with claim 11, wherein, when viewed in a planar or said transverse direction, said transverse flat flute is defined, between said hooks (19) laterally positioned on opposite sides thereof, by cut-outs (16) defining said flanks or edges of said flute, with said tongue (17) positioned between said flanks of said transverse flat flute when viewed in said planar or transverse direction thereto.

16. A hinge in accordance with claim 15, additionally comprising a hole (22) positioned through said spacer (2) between said actuating piece (18) and said oblong hole end (24), said transverse flat flute positioned between said hole (22) and said actuating piece (18).

17. A hinge in accordance with claim 1, wherein lower edges of said legs (8) of said spacer (2) are provided with protrusions (9) structured and arranged to engage corrugations provided on shoulders (10) of said base plate (1).

* * * * *